US006907999B1

(12) United States Patent
Carlin

(10) Patent No.: US 6,907,999 B1
(45) Date of Patent: Jun. 21, 2005

(54) STORAGE RACK WITH EASILY INSTALLABLE RETAINER LOOPS

(75) Inventor: James T. Carlin, Rocky River, OH (US)

(73) Assignee: Transilwrap Company, Inc., Franklin Park, IL (US)

( * ) Notice: Subject to any disclaimer, the term of this patent is extended or adjusted under 35 U.S.C. 154(b) by 167 days.

(21) Appl. No.: 10/375,515

(22) Filed: Feb. 26, 2003

(51) Int. Cl.[7] ..... A47F 1/00

(52) U.S. Cl. ..... 211/60.1; 211/89.01; 211/120; 211/69.8

(58) Field of Search ..... 211/60.1, 89.01, 211/70.6, 120, 94.01, 69.8

(56) References Cited

U.S. PATENT DOCUMENTS

| | | | | |
|---|---|---|---|---|
| 231,969 A | | 9/1880 | Perkins | |
| 586,238 A | | 7/1897 | King | |
| 1,026,241 A | | 5/1912 | Buckingham | |
| 1,214,606 A | * | 2/1917 | Steig | 211/120 |
| 1,222,728 A | * | 4/1917 | Brown, Jr. | 211/34 |
| 1,388,154 A | | 8/1921 | Coutts | |
| 1,429,846 A | | 9/1922 | Coutts | |
| 1,508,680 A | | 9/1924 | Daniels | |
| 1,746,577 A | | 2/1930 | Berglund et al. | |
| 1,822,734 A | | 9/1931 | Harrington | |
| 2,397,291 A | | 3/1946 | Robertson | |
| 2,430,624 A | | 11/1947 | Vollmer | |
| 2,591,805 A | | 4/1952 | Gossett | |
| 2,615,577 A | | 10/1952 | Bartleman | |
| 2,707,052 A | * | 4/1955 | Brown | 211/65 |
| D175,455 S | | 8/1955 | Bartleman | |
| 2,975,949 A | | 3/1961 | Lutsky | |
| 3,094,129 A | | 6/1963 | Wills | |
| 3,165,283 A | | 1/1965 | Borisof | |
| 3,305,100 A | | 2/1967 | Barbee | |
| 3,309,052 A | | 3/1967 | Borisof | |
| 3,363,340 A | | 1/1968 | McKinley | |
| 3,388,809 A | | 6/1968 | Irish | |
| 3,405,809 A | | 10/1968 | Schatz | |
| 3,731,818 A | * | 5/1973 | Young | 206/317 |
| 3,812,976 A | | 5/1974 | Rempel | |
| 4,176,752 A | | 12/1979 | Taber | |
| 4,600,110 A | * | 7/1986 | Timor | 211/120 |
| 4,757,906 A | | 7/1988 | Ovitz, III | |

(Continued)

FOREIGN PATENT DOCUMENTS

| | | |
|---|---|---|
| GB | 8483 | 4/1904 |

* cited by examiner

*Primary Examiner*—Leslie A. Braun
*Assistant Examiner*—Khoa Tran
(74) *Attorney, Agent, or Firm*—Cook, Alex, McFarron, Manzo, Cummings & Mehler, Ltd.

(57) ABSTRACT

A storage rack for small articles including an elongated carrier having a bottom wall, side and end walls and an open top. An elongated support bar holder, having a base and upstanding end walls, is dimensioned to be fitted in and be received in the elongated carrier. An elongated support bar extends between the end walls of the support bar holder and is spaced from the base of the support bar holder. The elongated support bar has a transverse cross-section which is non-circular in shape. A number of retainer loops are mounted side by side on the elongated support bar. Each retainer loop is formed of a strip of a tough, resilient, abrasion-resistant resin and has a bight portion and two legs. A passage is formed in each leg near its distal end for mounting the retainer loops on the elongated support bar. Each passage has a shape similar to but slightly larger than the non-circular transverse cross-section of the elongated support bar. One of the end walls of the support bar holder is hingedly connected to the base for movement towards and away from the support bar. A tenon and mortise joint are formed to connect the hingedly connected end wall to the elongated support bar.

3 Claims, 2 Drawing Sheets

U.S. PATENT DOCUMENTS 4,936,469 A * 6/1990 Drower ..... 211/69.8
5,398,823 A 3/1995 Anders
5,419,443 A * 5/1995 Niederberger et al. ..... 211/70.6
5,570,794 A * 11/1996 Drower ..... 211/89.01
5,718,342 A * 2/1998 Drower et al. ..... 211/60.1
5,775,520 A * 7/1998 Drower ..... 211/89.01
5,779,066 A * 7/1998 Drower et al. ..... 211/89.01
5,915,573 A * 6/1999 Drower et al. ..... 211/89.01
5,971,164 A * 10/1999 Wong ..... 211/40
5,971,165 A * 10/1999 Levins ..... 211/43

STORAGE RACK WITH EASILY INSTALLABLE RETAINER LOOPS

BACKGROUND OF THE INVENTION

Storage racks for small articles, ranging from pencils and pens to other items such as paint brushes, cassettes and small containers are shown in U.S. Pat. Nos. 4,936,469; 5,570,794 and 5,718,342. The racks of these patents are not specifically intended to support thin, planar objects such as business calling cards, index cards and file folders of the type which are usually stored in an upright or upstanding orientation in offices but instead were designed to support such articles in a hanging or vertical orientation although such racks could be used for storage of business calling cards, index cards and file folders if desired.

SUMMARY OF THE INVENTION

It is a principal object of the present invention to provide a storage rack or container for thin, planar objects such as business calling cards, index cards and even file folders that can handily be located on a desk, credenza, file cabinet or table where the storage rack supports the planar objects in an upstanding or upright orientation.

Another object of this invention is a storage rack or container for thin, planar objects such as cards and file folders which securely supports the objects regardless of their size or thickness.

An additional object of this invention is a storage rack or container for cards or file folders in which the retainer loops can be easily installed on or removed from a support bar.

Another object of this invention is a storage rack or container in which the retainer loops are positively retained on the support bar without the necessity of separately installed fasteners.

Yet another object of this invention is a storage rack or container in which all of the components of the storage rack, except for the retainer loops, can be injection molded.

Yet another object of this invention is a storage rack or container having a carrier which adds stability to the rack when used on a supporting surface such as a desk top.

Other objects of this invention may be found in the following specification, claims and drawings.

BRIEF DESCRIPTION OF THE DRAWINGS

The invention is illustrated more less diagrammatically in the following drawings wherein.

DESCRIPTION OF THE PREFERRED EMBODIMENTS

Figure 4:
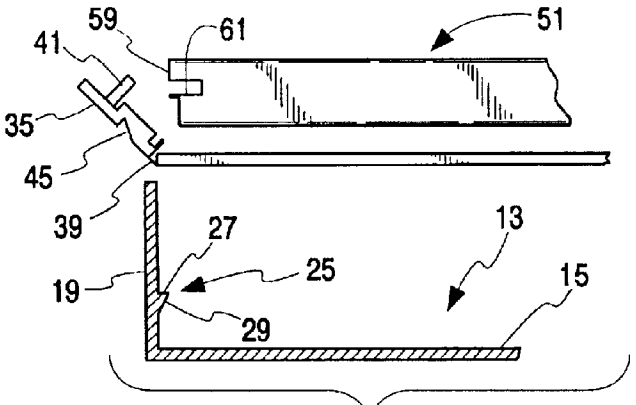
FIG. 4 is an enlarged partially exploded view of a portion of the storage rack with some parts shown in a moved position.
Figure 3:
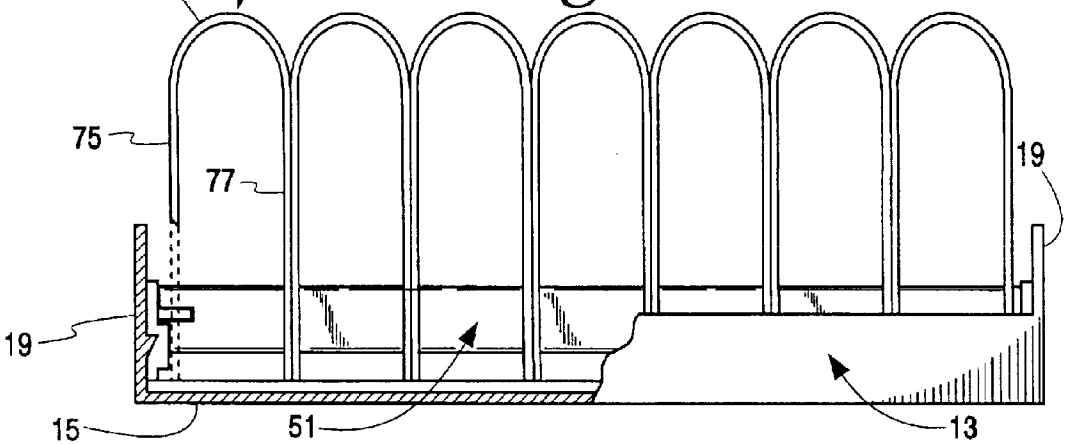
FIG. 3 is a side elevational view of the storage rack or container of FIG. 1 with some parts broken away, others shown in dashed lines and some shown in cross-section for clarity of illustration.
Figure 1:
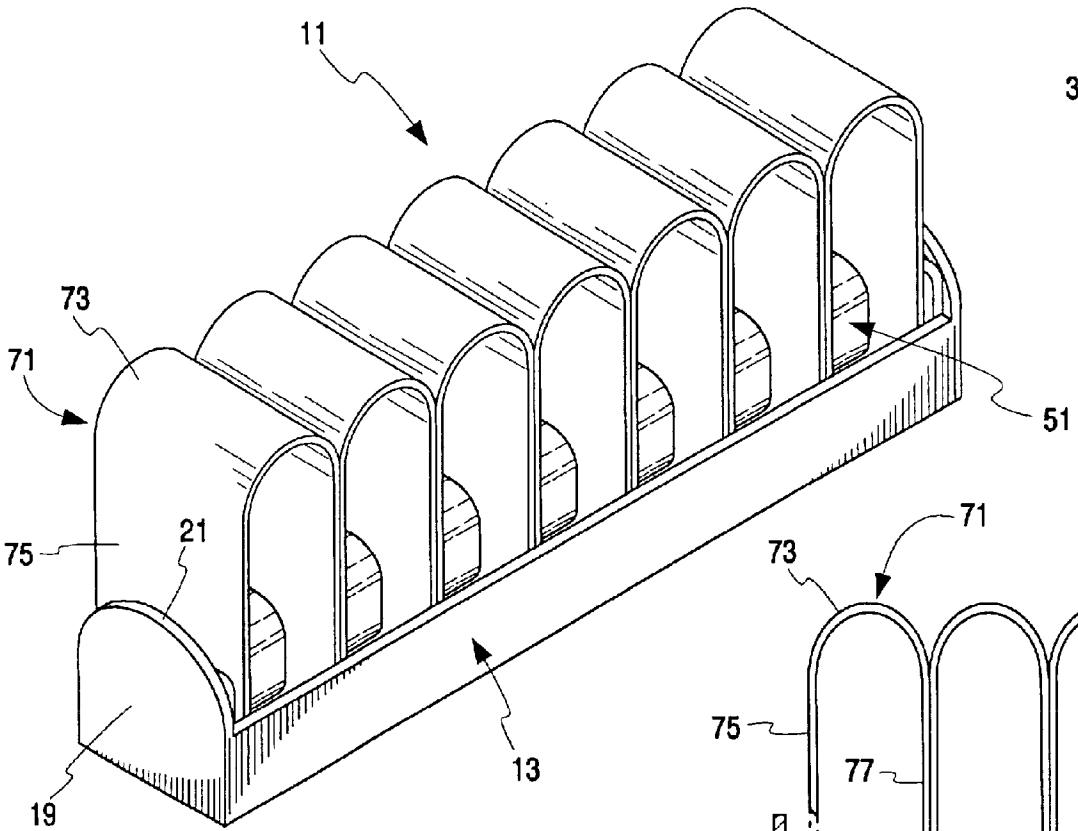
FIG. 1 is an orthographic view of a storage rack or container embodying the novel aspects of this invention.

The container or storage rack 11 embodying the novel aspects of this invention is shown in FIGS. 1–4 of the drawings. A rectangular shaped carrier 13 includes a bottom wall 15, side wall 17 and end walls 19. The end walls 19 rise above the side walls and are formed with arcuate top surfaces 21. These walls define an open top 23 for the carrier. The end walls 19 each have an inwardly located, inwardly facing projection 25 which includes an upwardly facing ledge 27 and an inclined side wall 29.

A support bar holder 31 is formed with a flat rectangular base 33 and end walls 35 and 37. End wall 35 includes an integral hinge connection 39 to the base 33 as is shown most clearly in FIG. 4 of the drawings wherein the end wall 35 is shown in its open or moved position. A rib 41 is formed integrally with the end wall 35 and extends inwardly thereof. An inwardly located ledge 43 is formed on the inside of each end wall 35 and 37. An outwardly facing triangular notch 45 is formed in the outer surface of each end wall 35 and 37.

An elongated support bar 51 is formed with a non-circular transverse cross-section to provide better support for the retainer loops and to prevent the retainer loops from pivoting around the support bar from a horizontal orientation which will be hereinafter described. The support bar is connected at one end 53 to end wall 37 and is supported on the end wall 37 by a notch 57 which rests on the ledge 43 formed as part of the end wall 37. At the opposite end 59 of the support bar, a slot 61 is provided which receives the rib 41 of the pivotal end wall 35 to support this end of the support bar when the end wall 37 is in its closed position as shown most clearly in FIGS. 2 and 3.

The storage holder further includes a plurality of retainer loops 71. Each retainer loop is formed of a strip of a tough, resilient, abrasive-resistant resin, preferably a polyester resin or a laminate thereof. The preferred construction for each retainer loop is two layers of oriented polyethylene terephthalate laminated with a central layer of polyethylene, the same basic construction as is used is commercial identification cards and similar articles.

Each retainer loop 71 is formed with a bight portion 73 joining a pair of legs 75,77. A passage 79 is formed in each leg 75 and 77 with each passage being located near the distal end of its leg. The passages may be formed by stamping, cutting or in any other conventional manner suitable for forming a passage in a laminate strip of plastic. The passages are similar in shape to the transverse cross-section of the support bar 51 being only slightly larger than the transverse cross-section of the support bar for ease of installing the retainer loops on the support bar.

Figure 2:
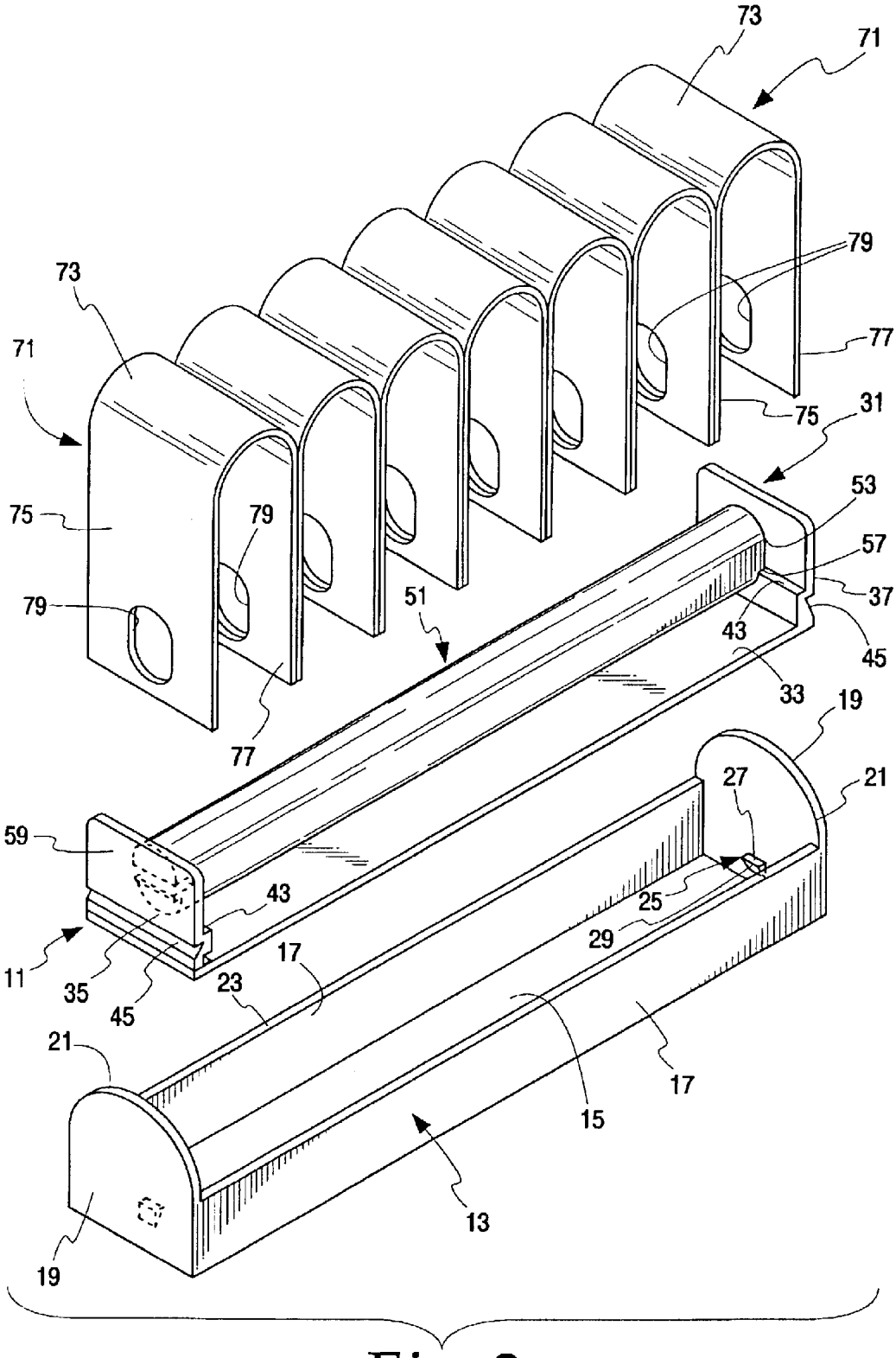
FIG. 2 is an orthographic exploded view of the storage rack or container of FIG. 1.

In order to install the retainer loop 71 on the support rod 53, the support bar holder 31 is removed from the carrier 13 as shown in the exploded view of FIG. 2 and the end wall 35 is moved to its open position as shown in FIG. 4 of the drawings to permit the passages 79 in the legs 75,77 of the retainer loops to be slid over the support bar 51. When the desired complement of retainer loops are mounted on the support bar 51, the end wall 35 is moved to its closed position wherein the rib 41 seats in the slot 61 at the end of the support bar 51 securing the retainer loops 71 in position. The support bar holder 31 is reinserted into the carrier 13 so that the outwardly facing triangular notches 45 in the outer surfaces of the end walls 35 and 37 engage and rest on the upwardly facing ledges 27 formed on the interiors of the end walls 19 of the carrier 13.

What is claimed is:

1. A storage rack for small articles, including:

an elongated carrier having a bottom wall, side and end walls and an open top, an elongated support bar holder having a base and upstanding end walls with said support bar holder dimensioned to be received in said elongated carrier, an elongated support bar extending between said upstanding end walls of said support bar holder and spaced from said base of said support bar holder, said elongated support bar having a transverse cross-section which is non-circular and;

a multiplicity of retainer loops mounted side by side on said elongated support bar, each retainer loop formed of a strip of a tough, resilient, abrasion-resistant resin and having a bight portion and two legs, a passage formed in each leg near its distal end for mounting said retainer loop on said elongated support bar, each passage having a shape similar to but larger than said non-circular transverse cross-section of said elongated support bar, one of said end walls of said support bar holder hingedly connected to said base for movement towards and away from said elongated support bar, and means for supporting formed on said hingedly connected end wall and said elongated support bar to support said elongated support bar on and connected to said hingedly connected end wall.

2. The storage rack of claim 1 in which said means to support said elongated support bar on and connected to said hingedly connected end wall includes a rib and slot joint.

3. The storage rack of claim 1 in which a ledge is formed on each end wall of said carrier and a recess adapted to receive said ledges formed on each end wall of said support bar holder to support said support bar holder in said carrier.

* * * * *